United States Patent [19]

Proud et al.

[11] Patent Number: 4,721,888

[45] Date of Patent: Jan. 26, 1988

[54] ARC DISCHARGE LAMP WITH ULTRAVIOLET ENHANCED STARTING CIRCUIT

[75] Inventors: Joseph M. Proud, Wellesley Hills; Wojciech W. Byszewski, Concord; Charles N. Fallier, Jr., Westford, all of Mass.

[73] Assignee: GTE Laboratories Incorporated, Waltham, Mass.

[21] Appl. No.: 686,975

[22] Filed: Dec. 27, 1984

[51] Int. Cl.[4] ..... H01J 7/44; H01J 17/34

[52] U.S. Cl. ..... 315/60; 315/59; 315/150; 315/289

[58] Field of Search ..... 315/248, 289, 60, 331; 250/372, 373, 504 R; 313/54

[56] References Cited

U.S. PATENT DOCUMENTS

| | | | |
|---|---|---|---|
| 3,226,597 | 12/1965 | Green | 315/60 |
| 3,900,761 | 8/1975 | Freese et al. | 315/60 |
| 3,970,886 | 7/1976 | Bode et al. | 315/169.4 |
| 3,997,816 | 12/1976 | Haugsjaa et al. | 315/267 |
| 4,041,352 | 8/1977 | McNeill et al. | 315/248 |
| 4,053,814 | 10/1977 | Regan et al. | 315/248 |
| 4,097,777 | 6/1978 | Bacharowski | 315/60 |
| 4,185,228 | 1/1980 | Regan | 315/248 |
| 4,247,800 | 1/1981 | Proud et al. | 315/39 |
| 4,302,699 | 11/1981 | Keeffe et al. | 313/229 |
| 4,308,483 | 12/1981 | Keeffe et al. | 313/214 |
| 4,321,501 | 3/1982 | English et al. | 313/197 |
| 4,321,504 | 3/1982 | Keeffe et al. | 313/214 |
| 4,325,004 | 4/1982 | Proud et al. | 315/45 |
| 4,328,446 | 5/1982 | Fallier, Jr. et al. | 315/47 |
| 4,353,012 | 10/1982 | Fallier, Jr. et al. | 315/289 |
| 4,355,261 | 10/1982 | Cohen et al. | 315/47 |

OTHER PUBLICATIONS

*Electric Discharge Lamps*, Waymouth, John F., MIT Press, 1971, pp. 181–184, 264–266.

*Primary Examiner*—Leo H. Boudreau
*Assistant Examiner*—Theodore Salindong
*Attorney, Agent, or Firm*—Hamilton, Brook, Smith & Reynolds

[57] ABSTRACT

An apparatus and method for increasing the reliability of an arc discharge occurring in metal halide gas discharge lamps by providing UV radiation in the gas discharge path.

11 Claims, 7 Drawing Figures

ARC DISCHARGE LAMP WITH ULTRAVIOLET ENHANCED STARTING CIRCUIT

DESCRIPTION

TECHNICAL FIELD

The invention relates to the starting of high pressure metal vapor arc discharge lamps and is especially useful with such lamps having a metallic halide fill.

BACKGROUND ART

High pressure metal halide arc discharge lamps have established themselves as valuable lighting sources. Such lamps generally comprise an elongated arc tube enclosed within an outer envelope or jacket commonly provided with a screw base at one end. The arc tube contains an ionizable fill including an inert buffer gas, mercury and metallic halides, and two main electrodes. The electrodes are supported by inleads including molybdenum foil portions extending through press seals at the ends of the tube. The foils assure hermetic seals withstanding thermal expansion of the parts.

In order to facilitate starting of the arc discharge, a starter electrode may be provided in the arc tube adjacent to one of the main electrodes. A discharge can be ignited between the starter electrode and the adjacent main electrode at a much lower applied voltage than is required to ignite an arc between the two main electrodes. Once the discharge is started, the ionized gas decreases the resistance between the two main electrodes and, if enough potential is available, the arc transfers and settles in the gap between the main electrodes. A resistor connected in series with the starter electrode limits the current flowing through it.

Metal halide lamps on the whole require higher voltages for reliable starting and operation than do high pressure mercury vapor lamps of corresponding size or rating. Conventional lead-lag ballasts for high pressure mercury vapor lamps do not deliver sufficient voltage for reliable starting. Therefore, circuits have been developed to increase the voltage output delivered by a conventional lead-lag ballast during starting. U.S. Pat. No. 3,900,761 to Freese, et al., describes one such circuit and U.S. Pat. No. 4,097,777 to Bacharowski describes an improvement on the Freese, et al. circuit. A later improvement, U.S. Pat. No. 4,353,012 to Fallier and Proud, describes a pulse injection starting circuit for high intensity metal halide lamps utilizing a spiral line generator to generate a high amplitude starting pulse.

DISCLOSURE OF THE INVENTION

We have found that even with the improvements above described, there is a substantial statistical lag time between the time the high voltage is applied to the lamp electrodes and the time gas breakdown and hence discharge occurs. By "statistical" lag time, we mean that the breakdown lag time for a given lamp and starting circuit is distributed over a range of values, such that, if the voltage is applied N times, the time at which breakdown occurs is distributed over a relatively wide range indicating that in some specific cases, the lag time is relatively short and in some cases, relatively long.

We have also found that the addition of a source of ultraviolet (UV) radiation adjacent the arc discharge lamp which is activated concurrent with the application of high voltage across the electrodes substantially lowers the statistical lag time. Also, the resultant lag time is very narrowly distributed. The UV radiation produces photoelectrons in the discharge gap which enhances gas breakdown and hence the initiation of discharge between the electrodes.

In the embodiments described herein, a high voltage spark gap is used as the UV radiation source.

BEST MODE OF CARRYING OUT THE INVENTION

Figure 1:
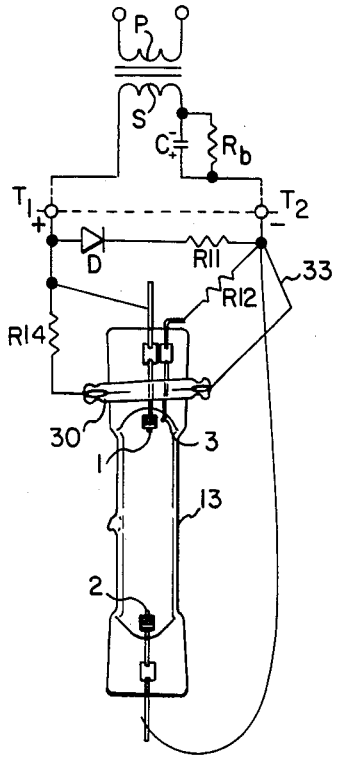
FIG. 1 is a schematic diagram of an arc discharge lamp including the prior art starting circuit of the Bacharowski patent connected across a lead-lag ballast but with the addition of the spark gap 30 and resistor 14, in accordance with the invention.
Figure 2:
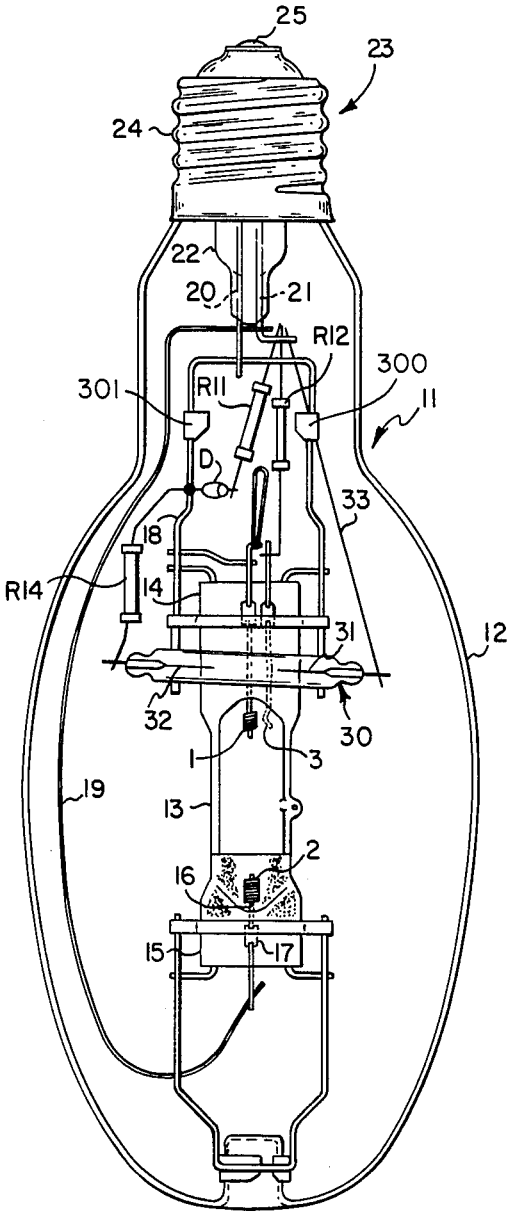
FIG. 2 shows a complete packaged metal halide lamp embodying the invention.
Figure 3:
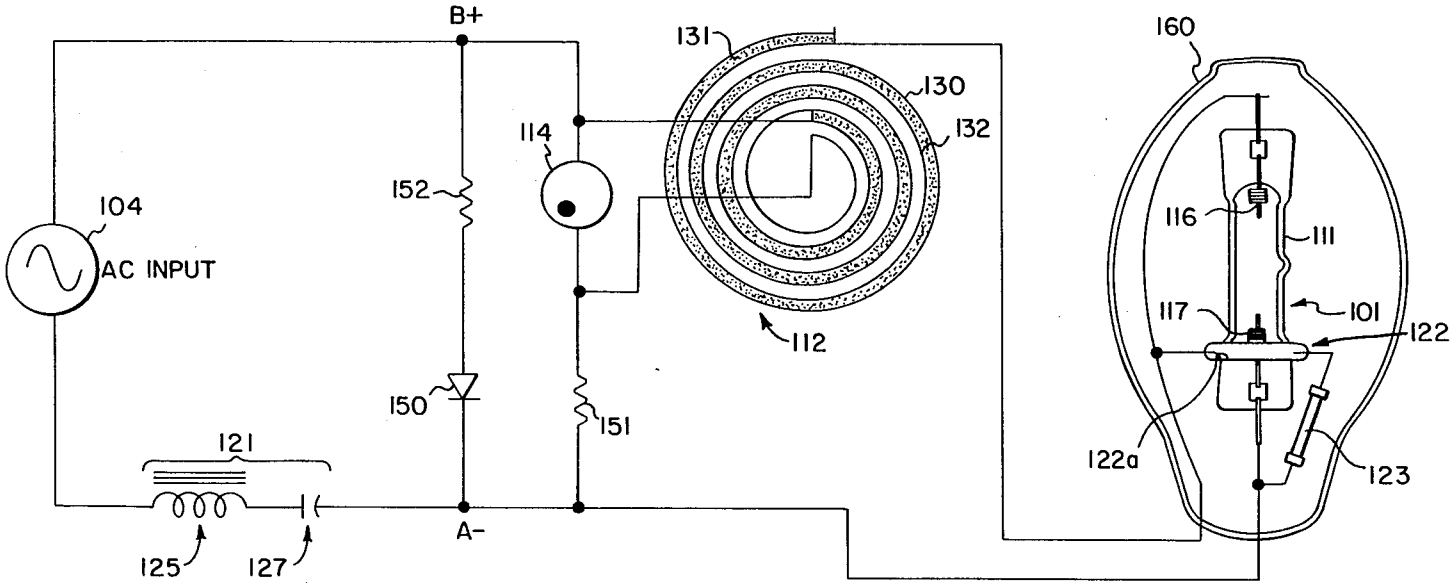
FIG. 3 is a schematic of an embodiment of the invention which utilizes a spiral line generator in the starting circuit.
Figure 4:
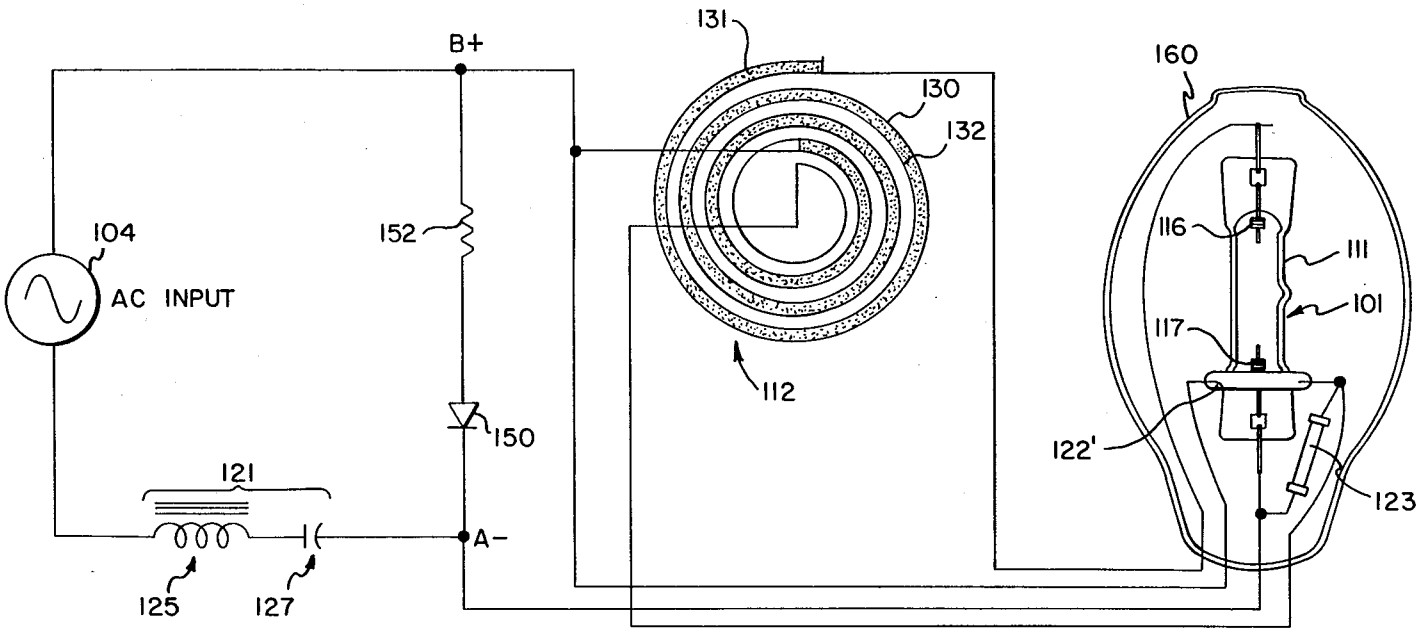
FIG. 4 is another embodiment of the invention with a spiral line generator and single spark gap.

The present invention of UV enhancement may be applied to any of the prior art starting aid circuits, e.g., Bacharowski type lead-lag circuit, or the Fallier and Proud spiral line generator circuit to improve starting reproducibility, to lower breakdown voltage and to shorten the discharge lag time. In FIGS. 1 and 2, the UV enhancement is shown in connection with a Bacharowski starting circuit. In FIGS. 3 and 4, UV enhancement is described in connection with a spiral line generator circuit. For illustrative purposes, a three electrode lamp is discussed in connection with FIGS. 1 and 2 and a two electrode lamp in connection with FIGS. 3 and 4.

I. Three Electrode Lamp With Bacharowski Type Starter

Referring now to FIGS. 1 and 2, there is shown a lead-lag type high intensity discharge lamp ballast which has a primary winding P, a seconary winding S loosely coupled to the primary to provide leakage reactance, and a series capacitor C in the secondary side. A bleeder resistor $R_b$ is indicated in parallel with capacitor C and may represent merely the leakage of the capacitor or a high value resistor connected in parallel. The lamp 11, through its base 23 and appropriate socket is connected across secondary terminals $T_1$ and $T_2$ via center contact 25 and outer contact 24.

Lamp 11 comprises an outer glass envelope 12 containing a quartz or fused silica arc tube 13 having flat pressed or pinched ends 14,15. Main electrodes, 1,2 are mounted in opposite ends of the arc tube, each including a shank portion 16 which extends to a molybdenum foil 17 to which an outer current conductor is connected.

The hermetic seals are made at the molybdenum foils upon which the fused silica of the pinches are pressed during the pinch sealing operation. The auxiliary starting electrode 3 is provided at the upper end of the arc tube close to main electrode 1 and consists merely of the inwardly projecting end of a fine tungsten wire. Main electrodes 1,2 are connected by conductors 18,19 to outer envelope inleads 20,21 sealed through stem 22 of the outer envelope. Molybdenum foil connectors 301 and 300 provide conductive continuity between portions of conductor 18 extending between the intersection of diode D and resistor 14 and the termination of conductor 18. The outer envelope inleads are connected to the contact surfaces of screw base 23 attached to the neck end of the envelope, that is to the threaded shell 24 and to the insulated center contact 25.

Arc tube 13 is provided with an ionizable radiation-generating filling including mercury and metal halide which reaches pressures of several atmospheres at normal operating temperatures from 600° to 800° C. One suitable filling comprises mercury, sodium iodide, scandium iodide, and an inert gas such as argon to facilitate starting.

The starter circuit, in accordance with the Bacharowski patent, comprises diode D and resistor $R_{11}$ connected in series and bridged across main electrodes 1 and 2 of the lamp 13. Starter electrode 3 is connected through resistor $R_{12}$ to remote main electrode 2.

When A.C. voltage is applied to the ballast, the ballast capacitor C initially charges towards the peak value of the secondary voltage with the polarity indicated. This occurs because when the polarity at terminal $T_1$ is positive as indicated, diode D conducts while on reverse polarity it blocks, and the current flow through diode D and charging resistor R11 gradually builds up a charge across capacitor C. As the capacitor charges, the D.C. voltage developed across it is superimposed on the A.C. secondary voltage developed by the ballast and is applied across the main electrodes in both circuits. It is also applied between main electrode 1 and starter electrode 3 through discharging resistance $R_{12}$.

As capacitor C continues to charge, the peak voltage comprising both A.C. and D.C. components applied across the starter gap between main electrode 1 and starter electrode 3 increases until it reaches a high enough value to break down the gap. The discharge between starting and main electrodes ionize the inert fill gas in the lamp 13 and the arc tube impedance drops to a finite value. Then the glow discharge existing between the adjacent main electrode 1 and the starting electrode 3 transfers to the remote main electrode 2, and then proceeds into a normal arc discharge.

What has been described, so far, in connection with FIG. 1 is the ballast and starter circuit shown in the Bacharowski patent. The present invention involves the addition of a voltage dropping resistor $R_{14}$ and a spark gap 30 across the lamp electrodes as shown in FIGS. 1 and 2, such that spark gap 30 is located adjacent lamp 13 and UV radiation from spark gap 30 is permitted to illuminate the discharge path between electrodes 1 and 3 and 2.

The resistor R14, of about 5000 ohms, is coupled to inlead 20 at a convenient point, such as at one end of diode D. The other end of R14 is coupled to terminal 32 of spark gap 30. Spark gap 30 is identical to commercially available devices, except that it is provided with a quartz envelope to enable UV radiation to be transmitted through the envelope. Terminal 31 of spark gap 30 is coupled via conductor 33 to inlead 21.

Thus, as voltage is generated by the ballast circuit of FIG. 1 and applied across the inleads 20 and 21 via contacts 25 and 24 of lamp 11, the Bacharowski starter circuit superimposes an additional D.C. bias voltage on the ballast voltage which is applied across the main electrodes 1 and 2 and across the starter electrode 3 and main electrode 2. Simultaneously, this superimposed voltage is applied across R14 and spark gap 30, connected in series.

Sufficient voltage is thus generated to create a discharge across electrodes 31 and 32 of spark gap 30. This discharge produces UV radiation which passes through the quartz envelope of arc tube 13 and creates photoelectrons in the space between the electrodes 1, 2 and 3. This results in a more readily ionizable discharge volume and enhancing the probability that a gas breakdown will occur between electrodes upon the application of high voltage across the lamp electrodes.

UV Enhancement Test

Figure 5:
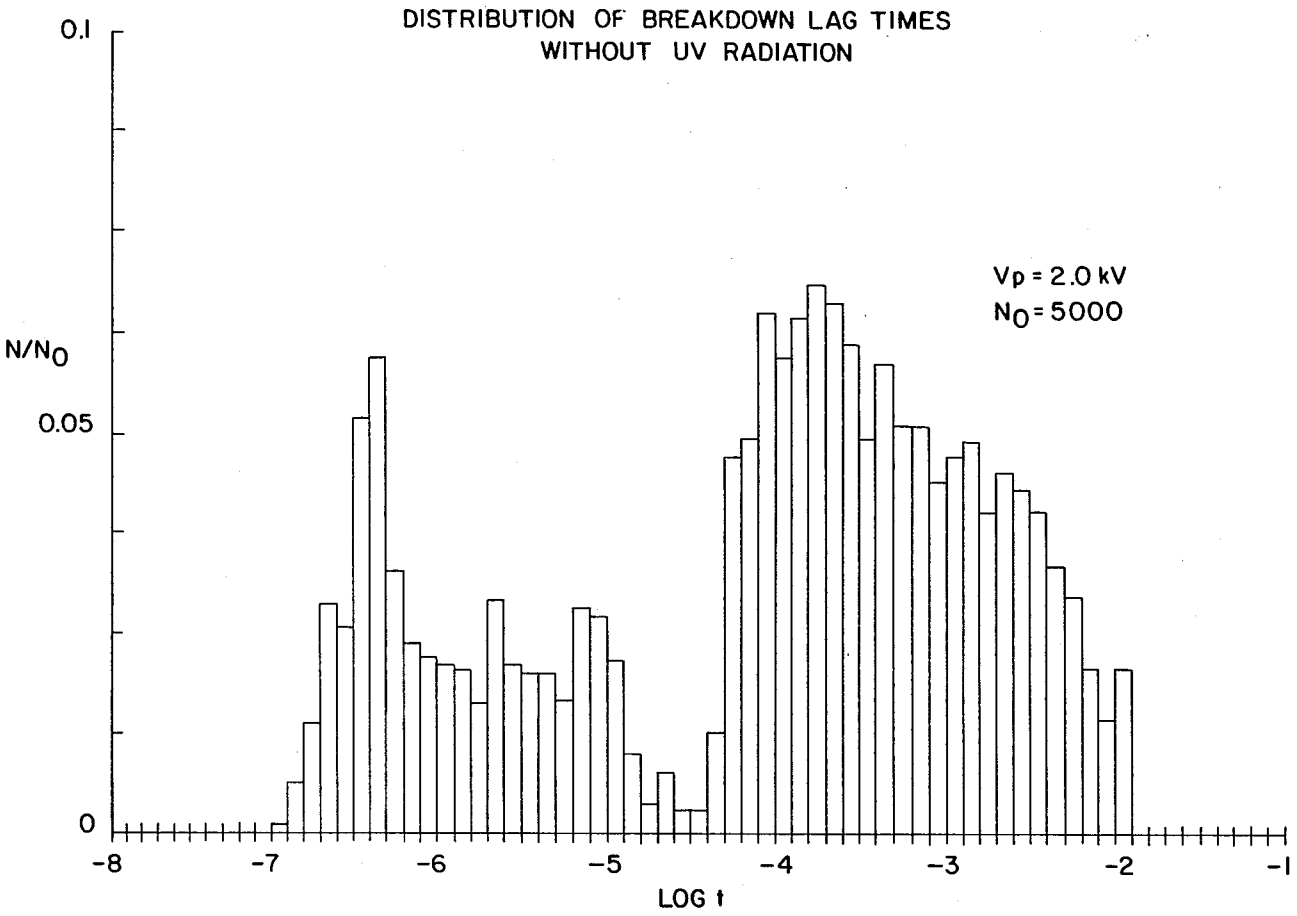
FIG. 5 is a plot of the ratio $N/N_o$ versus the lag time, for a metal halide −175 Watt lamp without the UV enhancement of the invention wherein $N_o$=the number of times a voltage is applied across the lamp electrodes and N=the number of times the applied voltage of 2.0 kV produced a discharge at time t.
Figure 6:
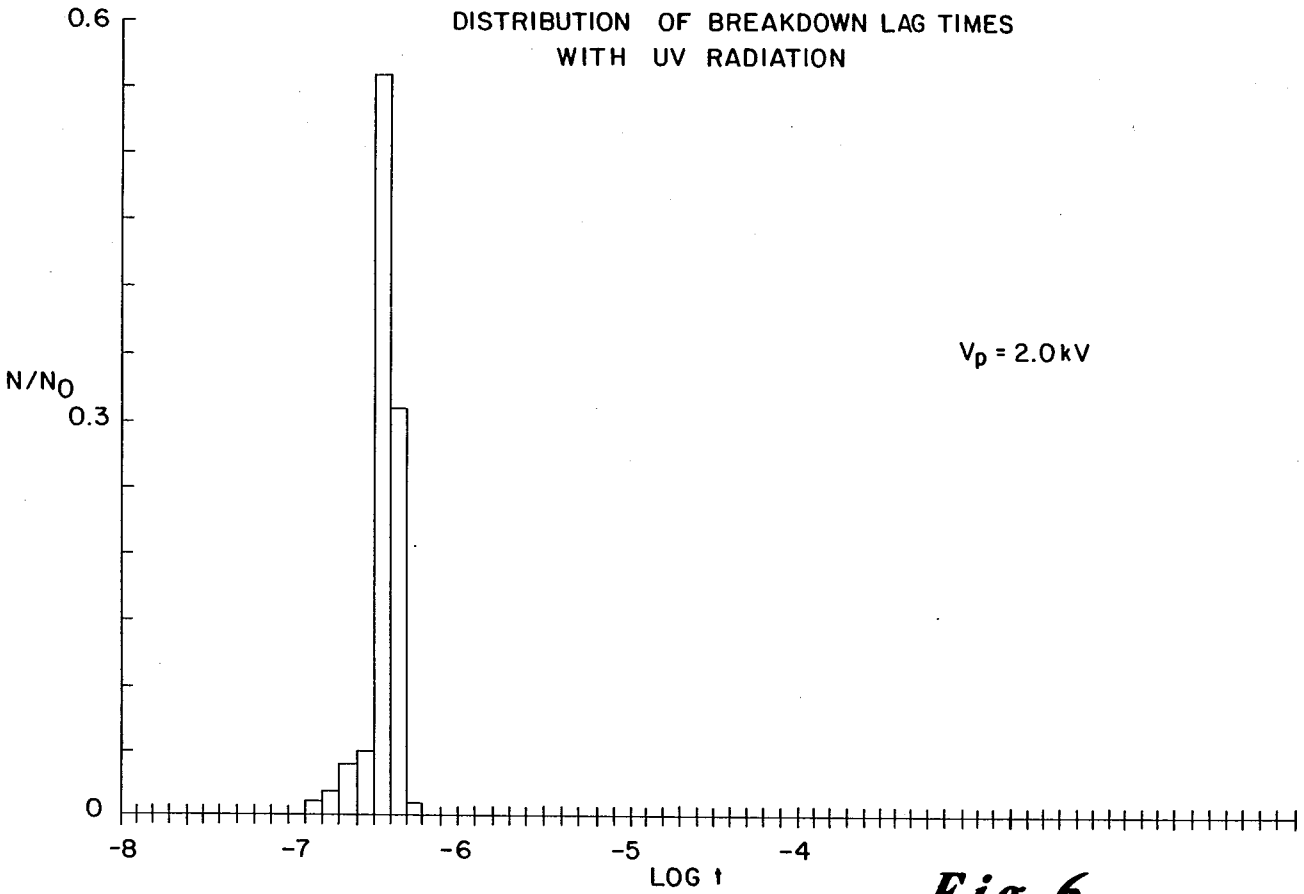
FIG. 6 is a plot as in FIG. 5 but including UV enhancement in accordance with the invention.

The dramatic effect of the UV radiation on the lag time between voltage application and the current flow through the lamp may be more fully appreciated by a comparison of FIGS. 5 and 6.

FIG. 5 is a plot of the distribution of the breakdown lag times of a two electrode 175 Watt metal halide high intensity discharge lamp as measured in a pulse test circuit without UV radiation. In FIG. 5, the ratio $N/N_o$ is plotted on the Y-axis versus the lag time "t" at which breakdown occurs in response to the application of a high voltage Vp. "N" is the number of times the applied voltage Vp of 2.0 kV produced a breakdown at time "t" and "$N_o$" is the total number of voltage applications or "shots"—i.e., 5000. The distribution ranges from an earliest time of about 0.01 microseconds to a latest time of about 10 milliseconds.

In contrast, the plot of FIG. 6 shows the same parameters for the same lamp and test circuit but with the addition of UV radiation supplied by a spark gap. As may be seen in FIG. 6, the distribution is very narrowly centered at about 0.5 microseconds.

We have also found that the pulse voltage required to start discharge, i.e., breakdown voltage, is significantly reduced by the UV enhancement, above described.

Figure 7:
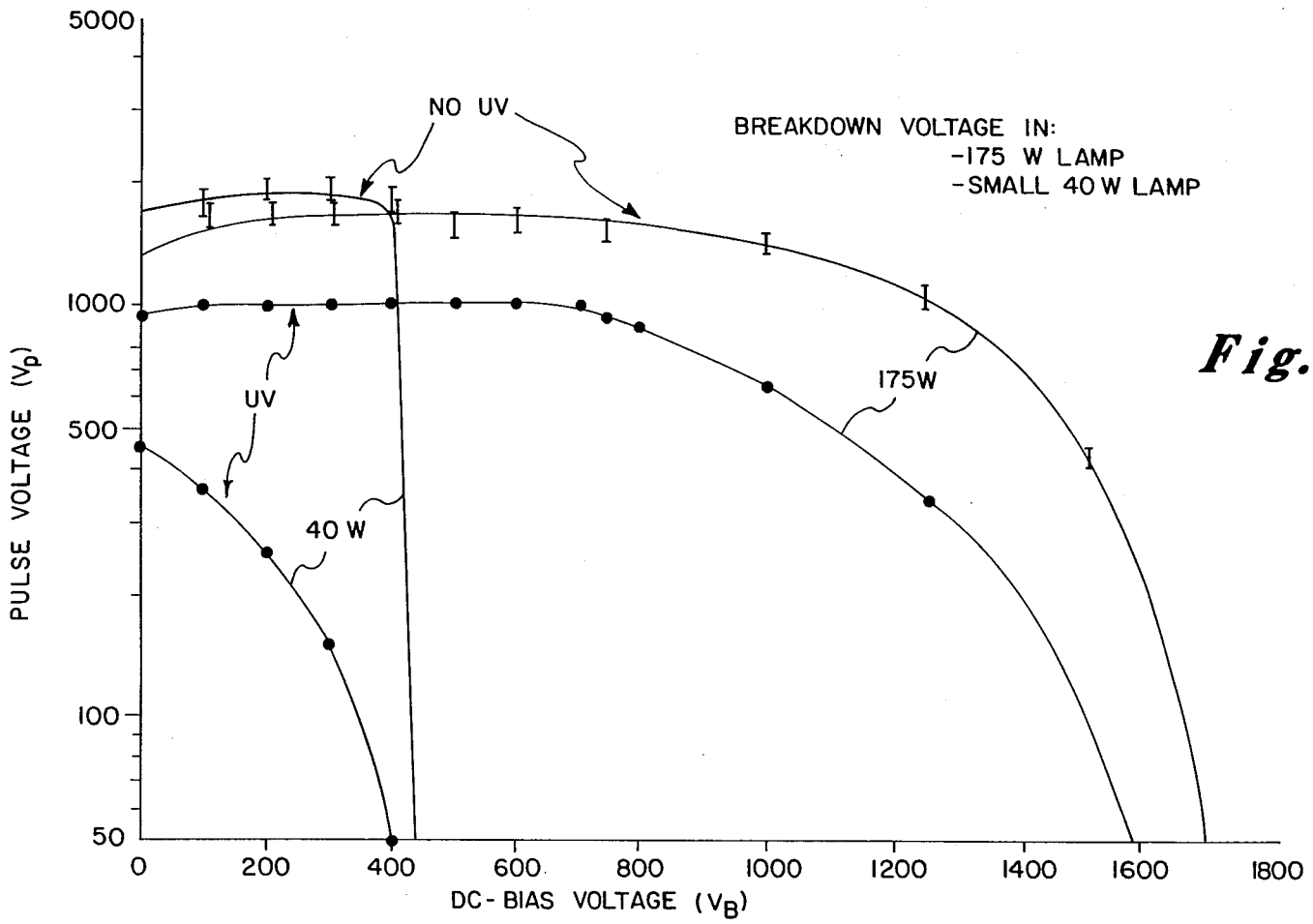
FIG. 7 is a plot of pulse voltage versus bias voltage with and without UV enhancement for 175 Watt and 40 Watt metal halide lamps.

The effect of UV enhancement on pulse breakdown voltage is illustrated in FIG. 7, which is a plot of pulse voltage $V_P$ versus D.C. bias voltage $V_B$ for a 175 Watt lamp and for a 40 Watt lamp. Two curves for each lamp type are shown, one each with UV enhancement, labelled UV, and one each without UV enhancement, labelled "NO UV".

The plots of these curves show the minimum voltage required for breakdown to occur within the pulse length of the applied voltage, $V_P$. Without UV enhancement, the pulse voltage $V_P$ required for breakdown in a 175 Watt lamp is approximately 1500 Volts and is practically independent of bias voltage, $V_B$. With UV enhancement, $V_P$ drops to approximately 1000 Volts and remains independent of $V_B$.

This effect is even more pronounced in the small 40 Watt lamp. The required breakdown voltage, $V_P$, is approximately 2000 Volts and remains so until the D.C. bias voltage $V_B$ reaches the D.C. breakdown voltage of approximately 450 Volts. In contrast, the pulse voltage, $V_P$, required for breakdown with UV enhancement, is very small. It is approximately equal to the difference between D.C. breakdown voltage (450 Volts) and the applied bias voltage, $V_B$. This indicates that with UV enhancement, this lamp would operate from a conventional 220 Volt lead-lag ballast.

II. Two Electrode Lamp With Spiral Line Generator

FIG. 3 illustrates a second embodiment of the invention. In this example, a spiral line generator 112 is used to start a two electrode, high intensity discharge lamp 101. The spiral line generator used is similar to generators described in U.S. Pat. Nos. 4,353,012, 4,328,446 and 4,325,004, to Proud and Fallier.

In this embodiment, a spark gap 122 and a series connected current limiting resistor 123 coupled in parallel across electrodes 116 and 117 of the lamp 101 serves as a generator for UV radiation to illuminate the discharge volume between the electrodes 116 and 117. Preferably, the spark gap 122 with a quartz envelope **122*a* is located inside an outer glass envelope 160** which is evacuated to insure proper optical coupling.

As shown in FIG. 3, an A.C. voltage from source 104 is applied to ballast 121, which typically comprises an inductor 125 coupled to a capacitor 127 to form a lead-lag circuit.

A diode rectifier circuit comprising diode 150 and resistor 152 is coupled across the ballast 121 and one side of the A.C. input source 104.

The spiral generator 112 comprises a pair of conductors 130 and 132 in the form of elongated sheets of conductive material separated by dielectric material 131 rolled together to form a multiple turn spiral configuration.

In operation, the A.C. input voltage from source 104 is coupled through ballast 121 across the points labelled "A−" and "B+". A voltage is developed across resistor 152 on negative swings of the ballast voltage. This resulting half-wave signal is superimposed on the A.C. ballast voltage between points A− and B+ to produce voltage pulses at alternate half cycles. When the voltage reaches a sufficient level to break down spark gap 114, the spiral line 112 generates a high voltage pulse which is then applied across electrodes 116 and 117 of lamp 101 and across spark gap 122 with resistor 123. When the spark gap 122 is discharged, UV radiation emitted from the gap passes through quartz envelope **122*a* and illuminates the volume between electrodes 116 and 117 of lamp 101 thereby enhancing the ionization of this path, and hence, enhancing the ability of the applied voltage to create a discharge across electrode 116 and 117**.

Thus, there is provided by this example, a small metal halide discharge lamp 101 which can be reliably started and operated without the requirement for a starting electrode and in which the spark gap 122 provides UV illumination to enhance discharge probability across the main electrodes 116 and 117 of lamp 101.

Modification of the embodiment of FIG. 3 may be achieved, as shown in FIG. 4, by using spark gap 122' for both the functions of switching spiral line generator 112 and UV illumination of the lamp volume. In the embodiment of FIG. 4, all parts are numbered corresponding to like parts in FIG. 3 and it may thus be seen that the spark gap 114 and dropping resistor 151 of FIG. 3 is deleted in FIG. 4 and spark gap 122' and resistor 123 wired in the same part of the circuit, except that in FIG. 4, the spark gap 122' and resistor 123 have been located within the outer envelope 160 so that when spark gap 122' is fired by the voltage pulse across points A− and B+, not only is the spiral line generator triggered by the discharge through the spark gap 122', but the resultant UV radiation from the spark gap 122' is used to enhance the discharge probability across main electrodes 116 and 117. The advantage in reduction of parts is, however, somewhat offset by the necessity of having four leads entering the evacuated envelope 160 in the FIG. 4 embodiment.

Equivalents

While there has been shown and described several preferred embodiments of the invention, it would be obvious to those skilled in the art that various changes and modifications may be made therein without departing from the scope of the invention, as defined by the appended claims.

What is claimed is:

1. A light source comprising:

(a) a lamp having a lamp envelope and a discharge tube within said envelope having not more than two electrodes sealed within an envelope of said tube, said electrodes being located at opposite ends of said tube and a fill material enclosed within said tube which emits light during discharge wherein said lamp discharges at a predetermined normal discharge voltage; and (b) a starting circuit including a spiral line pulse generator including two conductors and two insulators in a spiral configuration having a plurality of turns, said spiral line pulse generator including an output terminal coupled to one of said electrodes of said tube and a pair of input terminals, one of said input terminals and the other of said electrodes of said tube being adapted for coupling to a source of lamp operating power and for delivering lamp operating power, received from the source, through said spiral line pulse generator to said lamp;

(c) means for applying A.C. voltage between the conductors of said spiral line pulse generators, said AC voltage having a peak voltage; and (d) a spark gap switch within said lamp envelope coupled between the conductors of said spiral line generator and arranged to short circuit said conductors at a firing selected to be less than the peak of said A.C. voltage, and higher than the normal discharge voltage of said lamp whereupon said spiral line pulse generator provides at said output terminal a high voltage, short duration pulse of sufficient energy to initiate discharge in said lamp causing said A.C. voltage to drop below said firing voltage and UV radiation to be emitted by said spark gap switch to illuminate the discharge path in said tube to enhance the probability of such discharge occurring.

2. The light source as defined in claim 1 wherein said discharge tube is a metal halide discharge device.

3. An arc discharge lamp having an external lamp envelope within which a metal halide tube is contained such that an outer space is provided between the lamp envelope and the tube comprising:

(a) a metal halide tube containing an ionizable radiation-generating fill and having not more than two electrodes comprising a proximate main electrode and a remote main electrode sealed therein with an inner space provided between the two electrodes which electrodes are disposed within a tube envelope at opposite ends of said tube;

(b) an electrical circuit for applying starting voltage from a ballast circuit coupled to said electrodes, and (c) an ultraviolet radiation source enclosed in an ultraviolet transmitting envelope within said lamp envelope and coupled to the main electrodes of said tube and disposed adjacent the main electrodes of the tube to illuminate the inner space and enhance ionization in the inner space thereby to provide a primary source for enhancing the probability of the starting voltage creating a discharge across said main electrodes.

4. A light source having a light transmissive external envelope comprising:

(a) a high intensity discharge lamp within said external envelope including a discharge tube having a tube envelope and not more than a pair of electrodes sealed within the tube envelope, said tube envelope enclosing a fill material which emits light during discharge of the tube; and (b) a starting circuit for applying a high voltage pulse of short duration and sufficient energy across said electrodes to initiate discharge in said discharge tube; and (c) an ultraviolet radiation source within said external envelope and located adjacent the electrodes in said tube for emitting ultraviolet radiation to illuminate the interior of said tube with ultraviolet radiation, said radiation comprising a primary means to enhance the probability of such discharge occurring when such high voltage pulse is applied.

5. The light source of claim 4 wherein the ultraviolet source is electrically coupled in parallel across said electrodes, such that the UV radiation occurs coincident with application of energy to initiate discharge.

6. The lamp of claim 3 wherein said ultraviolet radiation source is electrically coupled across said two electrodes.

7. The lamp of claim 3 in which the outer space within the external lamp envelope is evacuated.

8. The lamp of claim 4 wherein the ultraviolet radiation source is enclosed in an ultraviolet transmitting envelope.

9. The lamp of claim 8 wherein the source is a spark gap electrically coupled across said electrodes.

10. The lamp of claim 4 in which the source of ultraviolet radiation is in a volume of evacuated space between the external envelope and the tube envelope.

11. A light source having a light transmissive external envelope comprising:

(a) a high intensity discharge lamp within said external envelope including a discharge tube having a tube envelope and not more than a pair of electrodes sealed within the tube envelope, said tube envelope enclosing a fill material which emits light during discharge of the tube; and (b) a starting circuit for applying a high voltage pulse of short duration and sufficient energy across said electrodes to initiate discharge in said discharge tube; and (c) an ultraviolet radiation source within said external envelope and located adjacent the electrodes of said tube for emitting ultraviolet radiation to illuminate said tube with ultraviolet radiation to lower a time duration between the time said high voltage pulse is applied to said electrodes and the time discharge occurs.

* * * * *